US006276309B1

(12) United States Patent
Zeek

(10) Patent No.: US 6,276,309 B1
(45) Date of Patent: Aug. 21, 2001

(54) HOT WATER HEATER CONTAINMENT SYSTEM

(76) Inventor: Barry Zeek, 3610 Rte. 23 North, Hamburg, NJ (US) 07419

( * ) Notice: Subject to any disclaimer, the term of this patent is extended or adjusted under 35 U.S.C. 154(b) by 0 days.

(21) Appl. No.: 09/492,470

(22) Filed: Jan. 27, 2000

(51) Int. Cl.[7] ..... F22B 37/46

(52) U.S. Cl. ..... 122/504; 122/507; 137/312; 340/605

(58) Field of Search ..... 122/14.3, 14.31, 122/504, 507, 4 A; 137/312, 313, 314; 340/604, 605

(56) References Cited

U.S. PATENT DOCUMENTS

| | | | | |
|---|---|---|---|---|
| 4,505,231 | | 3/1985 | Syler | 122/159 |
| 4,805,662 | | 2/1989 | Moody | 137/312 |
| 4,924,816 | | 5/1990 | Moore, Jr. et al. | 122/17 |
| 5,085,205 | * | 2/1992 | Hall et al. | 122/504 |
| 5,188,143 | | 2/1993 | Krebs | 137/312 |
| 5,280,802 | | 1/1994 | Comuzie, Jr. | 137/65 |
| 5,345,224 | * | 9/1994 | Brown | 340/605 |
| 5,365,891 | | 11/1994 | Hanning | 122/382 |
| 5,435,716 | | 7/1995 | Joyce | 431/7 |
| 5,531,214 | | 7/1996 | Cheek | 126/361 |
| 5,609,124 | | 3/1997 | Leclerc | 122/388 |
| 5,632,302 | | 5/1997 | Lenoir, Jr. | 137/312 |
| 5,794,609 | * | 8/1998 | Grant | 122/504 |
| 5,797,358 | | 8/1998 | Brandt et al. | 122/448.1 |
| 5,857,482 | * | 1/1999 | Dowling | 122/504 |
| 5,870,024 | * | 2/1999 | Arvelo, Jr. | 340/605 |
| 6,024,116 | * | 2/2000 | Almberg et al. | 122/504 |
| 6,084,520 | * | 7/2000 | Salvucci | 340/605 |

* cited by examiner

*Primary Examiner*—Gregory Wilson
(74) *Attorney, Agent, or Firm*—Ernest D. Buff & Associates, LLC; Ernest D. Buff, Esq.

(57) ABSTRACT

A hot water heater containment system holds, detects, and removes leaked water while also shutting off the water supply. The system additionally shuts off supply gas when leaking gas is detected, and sounds an alarm. A burner within the system is shielded against infiltration of flammable vapors from external sources. The shielding function is accomplished without preventing access to the burner for maintenance. Advantageously, the hot water containment system is inexpensive to construct, easy and safe to use, and highly reliable in operation.

5 Claims, 3 Drawing Sheets

HOT WATER HEATER CONTAINMENT SYSTEM

BACKGROUND OF THE INVENTION

1. Field of the Invention

The present invention relates to a water heaters; more particularly, to a hot water heater containment and safety system.

2. Description of the Prior Art

Various hot water heater safety systems are disclosed by the prior art. U.S. Pat. No. 4,805,662 to Moody, for example, relates to a hot water heater provided with a solenoid valve that controls the supply of cold water. The Moody device has a leakage collector means for collecting leaked water and a controller to shut the solenoid valve when a leak is detected. Similarly, U.S. Pat. No. 5,632,302 to Lenoir, Jr. discloses an overflow protection shut-off device for use with a water heater. The Lenoir, Jr. device shuts off a supply of water to the water heater when a leaking or an overflow condition occurs. Neither the Moody nor the Lenoir, Jr. patents disclose a containment system having a removable front panel; an audible gas leak detector; a pumping system; or means for preventing the infiltration of flammable vapors from external sources.

U.S. Pat. No. 4,924,816 to Moore, Jr. et al., discloses a water heater provided with a flame-spill prevention arrangement. The Moore, Jr. et al arrangement comprises, among other components, a combustion chamber with an inner door, and a unitary manifold assembly mounted within and covering an access opening to prevent spill-out of the burner flames therethrough. The Moore, Jr. et al. patent does disclose a containment system having a removable front panel; an audible gas leak detector; a pumping system with a cold water shut off solenoid valve; or means for preventing the infiltration of flammable vapors from external sources.

U.S. Pat. No. 5,797,358 to Brandt et al., discloses a multifunction control system for a water heater. The control system comprises a flammable gas sensor which discontinues gas supply if unsafe concentrations of the gas are detected. The '358 patent does not disclose a containment system having a removable front panel; a pumping system with a cold water shut off solenoid valve; or means for preventing the infiltration of flammable vapors from external sources.

While not directly related to safety, U.S. Pat. No. 4,505,231 to Syler discloses a water heater having a sediment removal means. The water heater of Syler comprises, among other components, a tubular agitator means mounted in the hot water tank.

Conventional containment systems of the type hereinabove described lack access to the burner. There is no disclosure in the prior art concerning a hot water heater containment system having, in combination, a removable front panel for accessing the burner; an audible gas leak detector; a pumping system with a cold water shut off solenoid valve; and an adjustable collar for preventing the infiltration of flammable vapors from external sources.

SUMMARY OF THE INVENTION

The present invention provides a hot water containment system that affords increased safety over conventional hot water heaters. Advantageously, the water containment system of the present invention holds, detects, and removes leaked water while also shutting off the water supply. In addition, when used with gas fired hot water heaters, the system shuts off supply gas when leaking gas is detected either inside or outside the water containment area and sounds an alarm. Still further, the system helps prevent the infiltration of flammable vapors from external sources from entering the burner, and provides access to the burner for maintenance.

In one embodiment, the invention provides a safety system for a hot water heater having a gas supply pipe. Generally stated, the system comprises a water containment means having a removable door and a channel for accommodating the gas supply pipe and pumping system. The containment means surrounds the lower portion of the hot water heater and has a drain plug for draining leaked water from the water containment means. A water level detector detects leaked water at a predetermined depth within the containment means, and an electrical switch is electrically connected between the water level detector and an electrical solenoid water valve. A water pump is used for pumping leaked water from the containment means. The pump is electrically connected to the electrical switch. In operation, the water level detector detects leaked water at a predetermined depth within the containment means and actuates the switch causing the pump to remove the water from the containment means.

In another embodiment, the invention provides a safety system for an electrical hot water heater. Generally stated, the system comprises a water containment means having a removable door. The containment means surrounds the lower portion of the hot water heater and has a drain plug for draining leaked water from the water containment means. A water level detector detects leaked water at a predetermined depth within the containment means. An electrical switch is electrically connected between the water level detector and an electrical solenoid water valve. A water pump is used for pumping leaked water from the containment means. The pump is electrically connected to the electrical switch. In operation, the water level detector detects leaked water at a predetermined depth within the containment means and actuates the switch causing the pump to remove the water from the containment means.

Optionally, the system further comprises a water solenoid valve that is electrically connected between the pump and the electrical switch. When actuated by the switch, the water solenoid valve closes until it is manually reset.

When used on a gas fired unit, the system further comprises a gas sensor for detecting leaking supply gas. A gas solenoid valve on the gas supply line is electrically connected to the gas sensor. The gas solenoid valve, when actuated, must be manually reset. The gas solenoid valve controls gas flow into the supply gas pipe. It is electrically connected to an alarm. When leaking gas is detected by the gas sensor, the system automatically causes the gas solenoid valve to actuate, the gas solenoid valve is caused to close, and the alarm to sound. The leaking gas is shut off within the containment area, and an audible alarm sounds, warning those in the vicinity of the heater that there exists a dangerous condition which requires immediate repair.

As still another option, the apparatus comprises an adjustable collar, for enclosing the containment means so that debris cannot accidentally be dropped into the containment area. In addition, the adjustable color helps assure that flammable vapors from external sources are excluded from the enclosed gas flame, and ignition of the vapors is substantially eliminated.

The present invention significantly enhances the overall safety of hot water systems. The removable front panel;

audible gas leak detector; pumping system with cold water shut off solenoid valve; and adjustable collar for prevention of flammable vapor infiltration cooperate, in combination, to provide a hot water containment system that is inexpensive to construct, easy and safe to use, and far more reliable in operation than conventional hot water systems.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1:
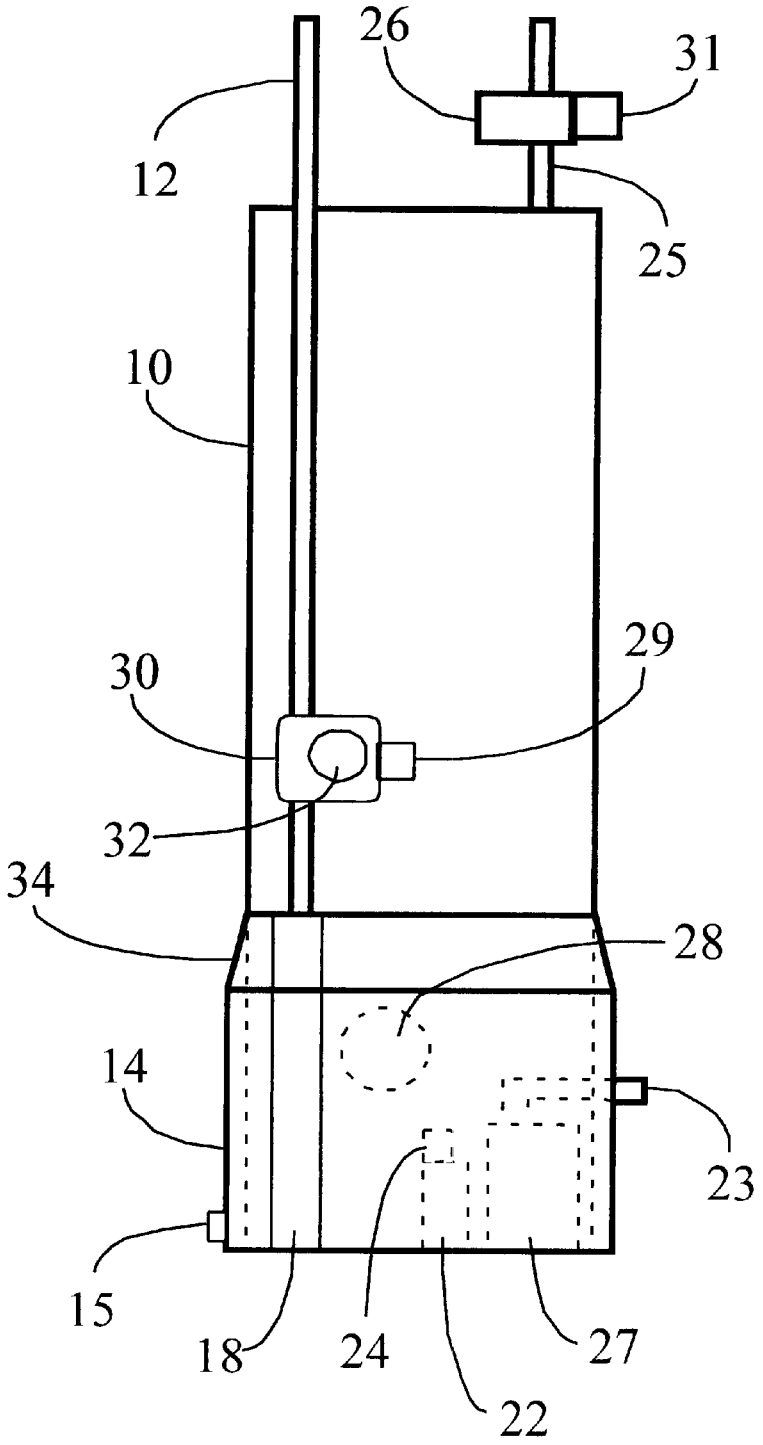
FIG. 1 shows a side view of a hot water heater outfitted with the various elements of the present invention.

The present invention provides a hot water heater containment and safety system. Advantageously, the system affords increased safety over conventional hot water systems. Water containment is accomplished despite leaks in the heater tank. The system holds, detects, and removes leaked water while also shutting off the water supply. In addition, the system shuts off supply gas when leaking gas is detected either inside or outside the containment area and sounds an alarm. Still further, the system helps prevent the infiltration of flammable vapors from external sources from entering the burner or other sources of ignition within the containment area, and provides access to the burner for maintenance Referring to FIGS. 1 and 2 of the drawings, there is shown a safety system for hot water heater 10 having gas supply pipe 12. Water containment means 14 surrounds the lower portion of hot water heater 10 with a water tight tub. Preferably, the height of containment means 14 is at least 18 inches; more preferably ranges from at least about 18 to 28 inches. Containment means 14 is also provided with drain plug 15 for draining leaked water, and water level detector 22 for detecting leaked water at a predetermined depth within containment means 14. Preferably, the predetermined depth is less than the height of the lowest point of the burner of water heater 10. Electrical switch 24 is electrically connected between water level detector 22 and electrical solenoid water valve 26. Water pump 27 is used for pumping leaked water from containment means 14 through exit pipe 23. Pump 27 is electrically connected to electrical switch 24. In this manner, water level detector 22 detects leaked water at a predetermined depth within containment means 14, and closes valve 26, stopping the flow of water into the water heater, and actuates switch 24, causing the pump 27 to remove the water from the containment means 14. Preferably, pump 27 and switch 24 are confined within containment means 14, but are optionally positioned outside with piped opening into containment means 14.

The system further comprises latch 31 associated with water solenoid valve 26 and electrically connected between pump 27 and electrical switch 24. When actuated by the switch 24, latch 31 causes water valve 26 to close, thereby stopping water flow into the water heater until latch 31, and hence water solenoid valve 26, is manually reset. Preferably, latch 31 is a standard solid state or electromechanical latch.

Figure 3:
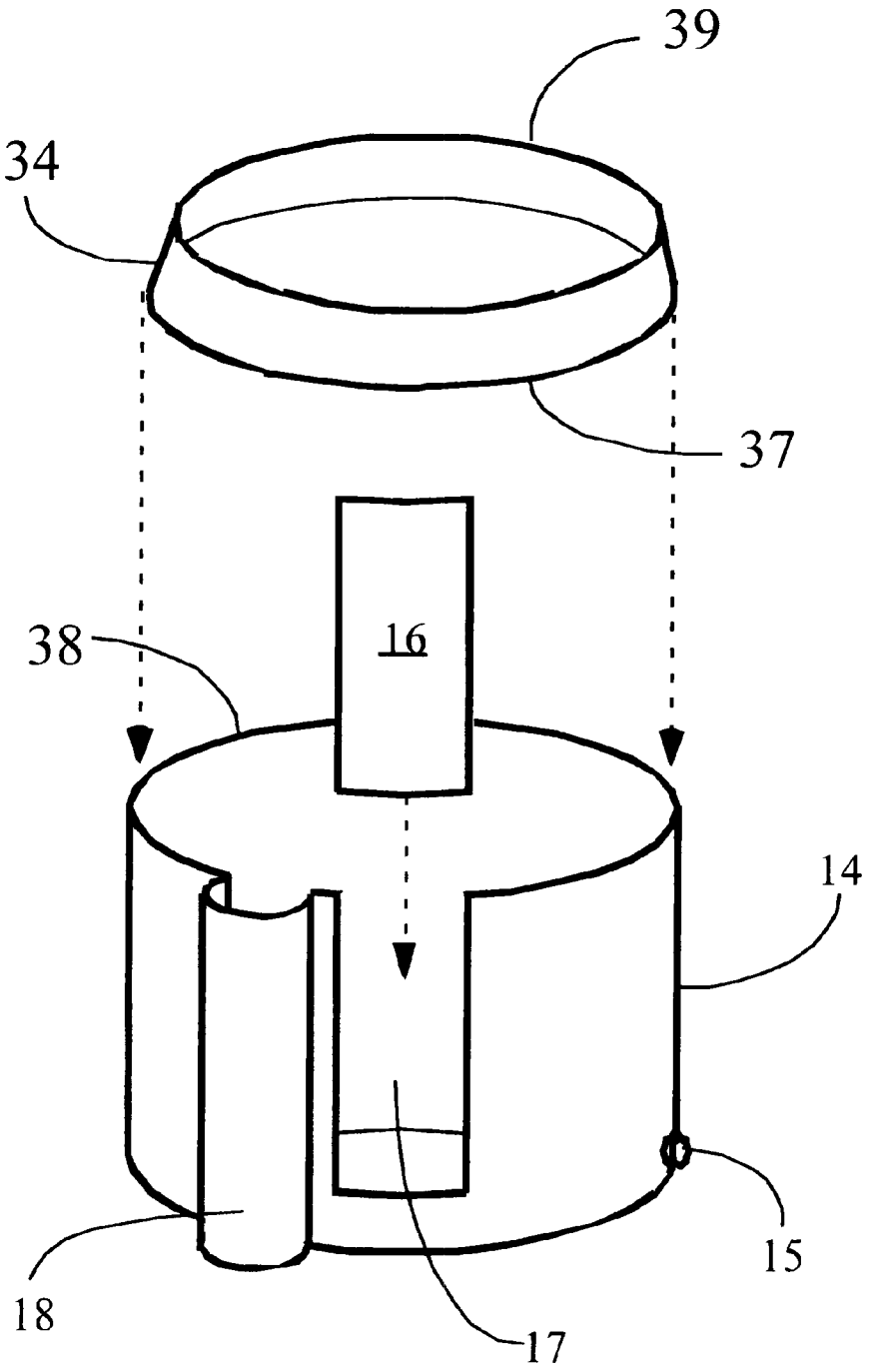
FIG. 3 shows a perspective view of the containment means and collar of FIG. 1.

FIG. 3 shows the perspective view of the containment means 14. As illustrated, containment means 14 has a channel 18 for accommodating the pumping system and gas supply pipe 12, and access door 16 for closing opening 17 therein. Opening 17 allows for easy access to the burner of the hot water heater.

Figure 2:
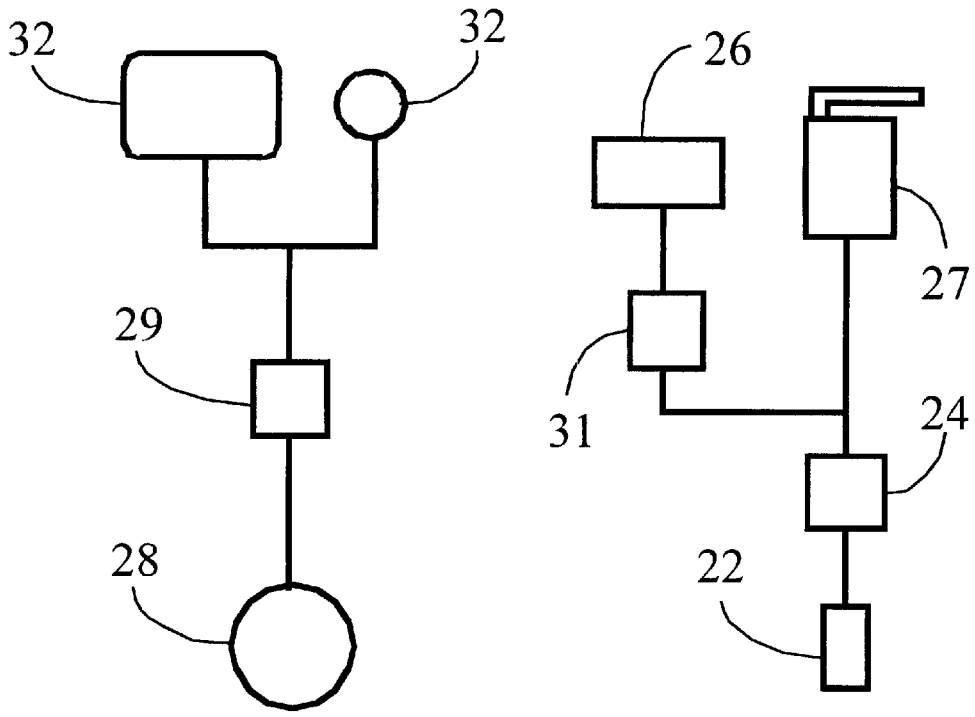
FIG. 2 is a schematic diagram of the electrical connections between the elements of the invention.

As shown in FIGS. 1 and 2, the apparatus further comprises gas sensor 28 which is electrically connected to an electrical latch 29, associated with gas solenoid valve 30. Gas sensor 28 is incorporated for detecting leaking gas emanating from a point either within or around the containment area. Latch 29, when actuated, latches, thereby closing gas solenoid valve 30, thereby stopping flow of gas therethrough until manually reset. Gas solenoid valve 30 is utilized to control the flow of gas into the heater's gas valve. The gas solenoid valve 30 and alarm 32 are electrically connected to electrical latch 29 through an electrical control circuit. In this manner, gas sensor 28, upon detecting leaking gas either inside or outside the containment area, causes latch 29 to actuate, thereby causing alarm 32 to sound and gas solenoid valve 30 to close, shutting off the leaking gas.

A further option is illustrated by FIGS. 1 and 3. The apparatus comprises an adjustable collar 34. The adjustable collar 34 encloses the lower portion of the water heater 10 to guard against accidental insertion of debris into the containment area while simultaneously aiding in the prevention of flammable vapor infiltration from coming in contact with any internal source of ignition. Collar 34 thereby prevents the infiltration of flammable vapors from external sources from engaging the burner, thereby eliminating ignition of the vapors.

Having thus described the invention in rather full detail, it will be understood that such detail need not be strictly adhered to, but that additional changes and modifications may suggest themselves to one skilled in the art, all falling within the scope of the invention as defined by the subjoined claims.

We claim:

1. A safety system for a hot water heater having a gas supply pipe, comprising:

a) a water containment means having a removable door and a channel for accommodating said gas supply pipe, said containment means surrounding the lower portion of said hot water heater to thereby provide a containment area;

b) a drain plug for draining leaked water from said water containment means;

c) a water level detector for detecting leaked water at a predetermined depth within said containment means;

d) an electrical switch electrically connected to said water level detector;

e) an electrical solenoid water valve electrically connected to said electrical switch;

f) a water pump for pumping leaked water from said containment means, said pump being electrically connected to said electrical switch, and g) an adjustable collar for enclosing said containment means to protect against debris being accidentally dropped into said containment area and to exclude from the enclosed gas flame flammable vapors from external sources, thereby substantially eliminating ignition of said vapors;

whereby said water level detector detects leaked water at a predetermined depth within said containment means and actuates said switch causing said pump to remove said water from said containment means.

2. A safety system as recited by claim 1, further comprising a water solenoid valve electrically connected between said pump and said electrical switch, said water solenoid valve, upon being actuated by said switch, being caused to close and remain closed until manually reset.

3. A safety system as recited by claim 1, wherein the height of said containment means is at least 18 inches.

4. A safety system as recited by claim 3, wherein the height of said containment means ranges from at least 18 inches to about 28 inches.

5. A safety system for a hot water heater having a gas supply pipe, comprising:

a) a water containment means having a removable door and a channel for accommodating said gas supply pipe, said containment means surrounding the lower portion of said hot water heater to thereby provide a containment area;

b) a drain plug for draining leaked water from said water containment means;

c) a water level detector for detecting leaked water at a predetermined depth within said containment means;

d) an electrical switch electrically connected to said water level detector;

e) an electrical solenoid water valve electrically connected to said electrical switch; and f) a water pump for pumping leaked water from said containment means, said pump being electrically connected to said electrical switch;

g) a gas sensor for detecting leaking supply gas, said gas emanating from a point either within or around said containment area;

h) a gas solenoid valve electrically connected to said gas sensor, said gas solenoid valve being constructed to require a manual reset after actuation;

i) said gas solenoid valve being operative to control the flow of gas into said supply gas pipe; and j) an alarm electrically connected to said gas solenoid valve;

whereby said water level detector detects leaked water at a predetermined depth within said containment means and actuates said switch causing said pump to remove said water from said containment means, and said gas sensor, upon detecting leaking gas, causes said gas solenoid valve to actuate thereby causing said gas solenoid valve to close and said alarm to sound, thereby shutting off said leaking gas within said containment area and sounding said alarm.

* * * * *